US005915303A

United States Patent [19]

Whiting et al.

[11] Patent Number: 5,915,303

[45] Date of Patent: Jun. 29, 1999

[54] SPRING CLIP PLATE RETAINER

[75] Inventors: Frederick J. Whiting, LaGrange; Randy Juras, Burbank, both of Ill.

[73] Assignee: Goss Graphic Systems, Inc., Westmont, Ill.

[21] Appl. No.: 09/024,349

[22] Filed: Feb. 17, 1998

[51] Int. Cl.[6] ..... B41F 27/12

[52] U.S. Cl. ..... 101/415.1

[58] Field of Search ..... 101/415.1, 483

[56] References Cited

U.S. PATENT DOCUMENTS

| | | | |
|---|---|---|---|
| 3,387,559 | 6/1968 | Horner | 101/383 |
| 3,757,691 | 9/1973 | Etchell et al. | 101/415.1 |
| 4,191,106 | 3/1980 | Fermi et al. | 101/415.1 |
| 4,214,530 | 7/1980 | Signorelli et al. | 101/415.1 |
| 4,376,414 | 3/1983 | Burger et al. | 101/415.1 |
| 4,557,196 | 12/1985 | Köbler | 101/415.1 |
| 5,107,763 | 4/1992 | Gevis | 101/415.1 |
| 5,156,091 | 10/1992 | Bätz | 101/415.1 |
| 5,370,051 | 12/1994 | Schild et al. | 101/415.1 |
| 5,375,520 | 12/1994 | Köbler et al. | 101/415.1 |
| 5,379,694 | 1/1995 | Haek et al. | 101/415.1 |
| 5,396,843 | 3/1995 | Dürr | 101/415.1 |
| 5,553,544 | 9/1996 | Ramsay | 101/415.1 |
| 5,555,807 | 9/1996 | Pollet | 101/415.1 |
| 5,598,780 | 2/1997 | Marmin et al. | 101/415.1 |
| 5,738,012 | 4/1998 | Metrope | 101/415.1 |

*Primary Examiner*—Edgar Burr
*Assistant Examiner*—Leslie Grohusky
*Attorney, Agent, or Firm*—Marshall, O'Toole, Gerstein, Murray & Borun

[57] ABSTRACT

One or more flexible printing plates are installed on a print cylinder through the use of one or more slots formed axially along the cylinder. A resilient spring clip is inserted into the slot, followed by a plate registration bracket with a registration pin which is secured in the slot by retaining screws. Each printing plate has a lead edge and a tail edge with a notch in each edge. A lead edge is inserted into the slot and is tensioned against a side wall of the slot by the spring clip. The notch on the lead edge engages the registration pin on the bracket. A tail edge is then inserted into the slot between the lead edge and the spring clip. The tail edge notch also engages the registration pin.

20 Claims, 6 Drawing Sheets

SPRING CLIP PLATE RETAINER

BACKGROUND OF THE INVENTION

1. Field of the Invention

The present invention relates to printing systems and, more particularly, to a device for retaining a flexible printing plate on a print cylinder of a printing machine.

2. Description of Related Art

In a printing machine, flexible printing plates are wrapped around the circumference of a printing cylinder. Various devices and techniques have been used to secure the plates to the cylinder.

For example, Köbler, U.S. Pat. No. 4,557,196 discloses an insert strip located in a groove on the printing cylinder for securing a printing plate around the cylinder. The insert strip has an inner guide portion which fits within the groove and a narrower separating wall portion that carries an abutment pin. The abutment pin is received within notches at the ends of the printing plate to maintain the lateral registration of the plate on the cylinder. The insert strip can be irremovably adhered to the groove in the cylinder or can be made axially slidable within the groove to allow for adjustment of the plate.

Gevis, U.S. Pat. No. 5,107,763, which is assigned to the same assignee as the present invention, discloses a resilient locking member which presses a curved tail member of the printing plate against the curved wall of a cavity in the cylinder. A lock rotor is mounted for rotation within the cavity such that when the rotor is rotated from a locked to an unlocked position, the locking member is disengaged from the cavity wall.

Batz, U.S. Pat. No. 5,156,091, discloses an axially adjustable register pin assembly positioned on an insertion bar that is received in the cylinder. The shiftable register pin assembly uses an eccentric adjusted bolt and spaced fastening screws positioned in elongated fastening holes to effect axial shifting of the register pin, which provides for shifting of the printing plate on the cylinder.

Köbler et al., U.S. Pat. No. 5,375,520, discloses a plurality of leaf-shaped springs disposed in a slot of the cylinder to retain the printing plates on the cylinder. The u-shaped springs have two legs which rest in the slot and one leg is elongated and tensions the edges of the printing plates against the wall of the slot.

There remains a need for a device for securely retaining printing plates on a cylinder which allows for easily installation and removal of the plates.

SUMMARY OF THE INVENTION

The present invention provides a simple arrangement that allows for easy installation and removal of printing plates on a cylinder. The present invention also provides a secure connection between the plates and the cylinder such that the plates will not become disengaged from the cylinder when the cylinder is rotated at high speeds.

According to one aspect of the present invention, a system for retaining one or more flexible printing plates on a print cylinder, wherein each printing plate has a first and second edge, comprises a slot formed axially along the cylinder, wherein the slot has first and second side walls and a bottom wall. A spring clip including a first elbow and a projection extending from a bottom portion of the spring clip, is inserted into the slot such that the projection resides on the bottom wall of the slot. A plate registration bracket including a registration pin is inserted into the slot atop the spring clip and engages the projection to secure the spring clip in the slot. A notch is formed on each edge of the printing plates and the first edge is inserted into the slot between the spring clip and the first side wall of the slot and the second edge is inserted into the slot between the first edge and the spring clip, such that the first elbow of the spring clip tensions the edges against the first side wall of the slot and the notches engage the registration pin on the plate registration bracket.

In a preferred embodiment of the invention, two retaining screws, located on opposite sides of the registration pin, secure the plate registration bracket to the slot. Also, the spring clip further includes a second elbow joining the middle portion and the bottom portion and the second elbow is tensioned against the second side wall of the slot. The spring clip also preferably has a cut-out middle section forming a u-shape and the registration pin on the plate registration bracket is located in the cut-out middle section of the spring clip. Further, the spring clip is preferably manufactured from a resilient material.

Also according to a preferred embodiment of the present invention, the slot is formed angularly into the cylinder and the cylinder includes a second slot located 180° from the first slot around the circumference of the cylinder. In this two-slot configuration, the lead edge of a first printing plate is inserted into the first slot and the tail edge of the first printing plate is inserted into the second slot. The lead edge of a second printing plate is inserted into the second slot and the tail edge of the second printing plate is inserted into the first slot.

According to another aspect of the present invention, a method for retaining one or more flexible printing plates on a print cylinder, wherein each printing plate has a first and second edge and a notch formed in each edge, comprises the steps of: (a) inserting a spring clip including a first elbow and a projection into a slot formed axially along the cylinder such that the projection resides on a bottom wall of the slot; (b) inserting a plate registration bracket including a registration pin into the slot atop the spring clip such that the bracket engages the projection to secure the spring clip in the slot; (c) inserting the first edge of a printing plate into the slot between the spring clip and a side wall of the slot, such that the first elbow of the spring clip tensions the first edge against the side wall and the notch in the first edge engages the registration pin; and (d) inserting the second edge of a printing plate into the slot between the spring clip and the first edge, such that the first elbow of the spring clip tensions the first and second edges against the side wall and the notch in the second edge engages the registration pin.

BRIEF DESCRIPTION OF THE DRAWING(S)

DESCRIPTION OF THE PREFERRED EMBODIMENT(S)

Figure 1:
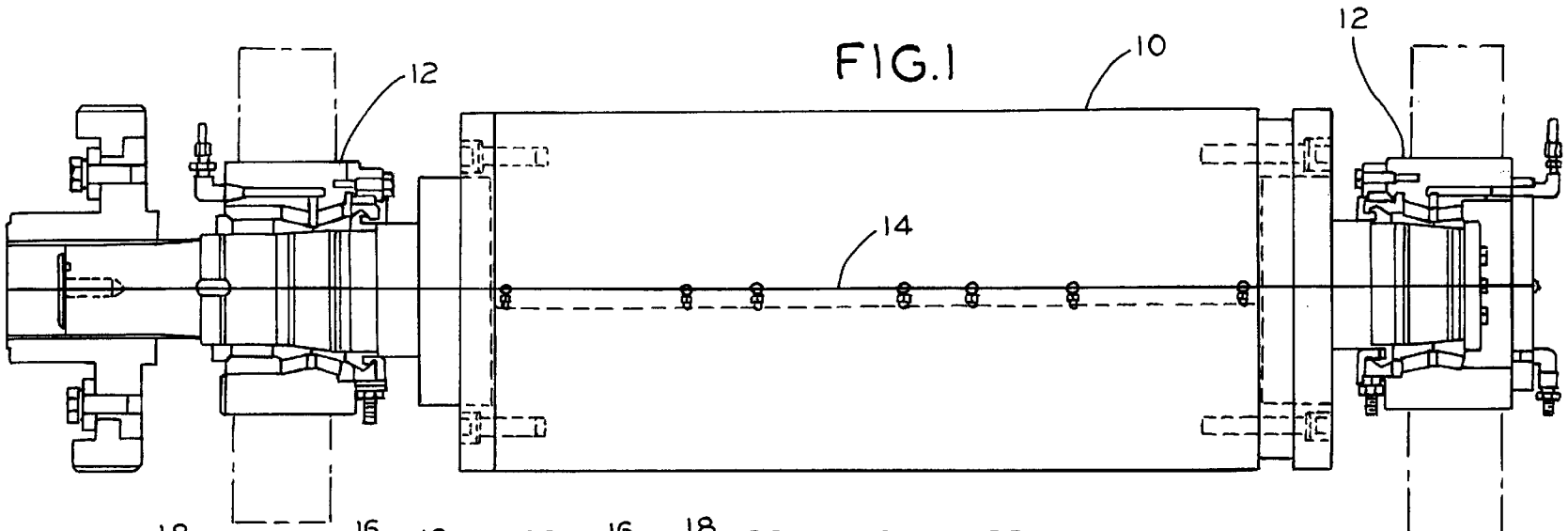
FIG. 1 is a planar view of a printing cylinder which utilizes the present invention.
Figure 6:
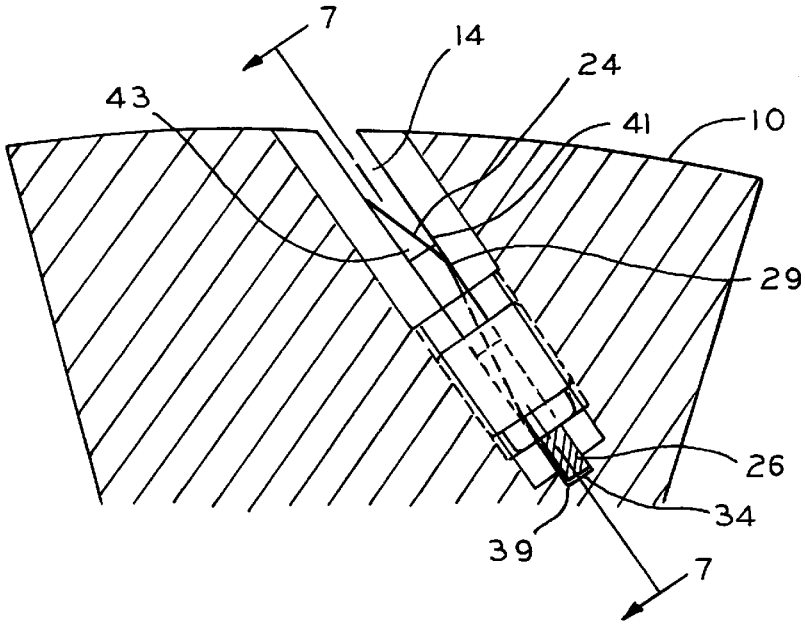
FIG. 6 is a cross-sectional view of the printing cylinder illustrating the spring clip and plate registration bracket inserted into the slot.

FIG. 1 exemplifies a printing cylinder 10, which includes drive bearings 12 on each end to facilitate rotation of the cylinder 10. The cylinder 10 includes at least one slot 14 which runs axially along the length of the cylinder 10. Also, the slot(s) 14 in the printing cylinder 10 are preferably formed at an angle, as best illustrated in FIG. 6.

Figure 2:
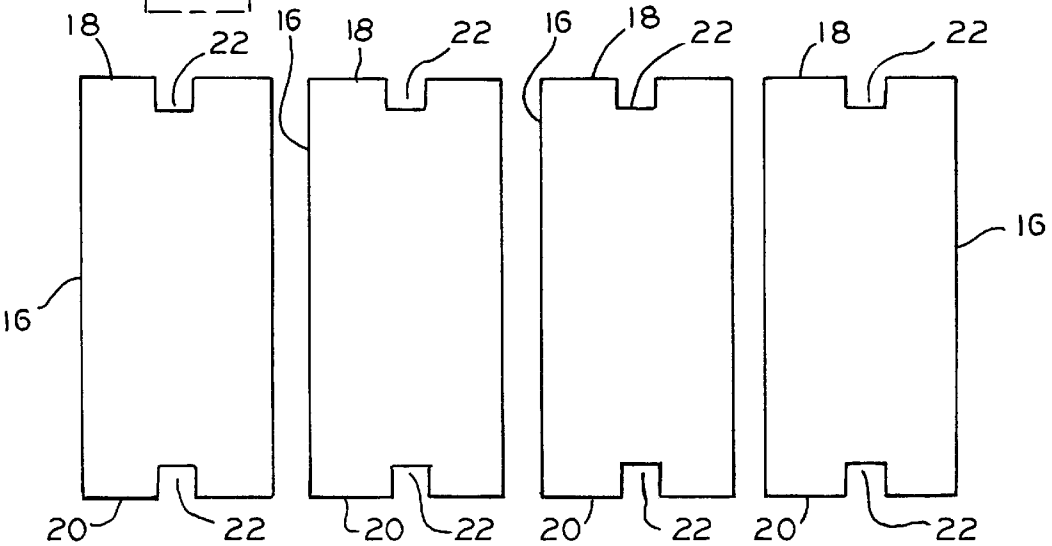
FIG. 2 is a planar view of a plurality of printing plates designed to be installed around the circumference of the printing cylinder of FIG. 1.

Referring also to FIG. 2, a plurality of flexible printing plates 16 are designed to fit around the circumference of the cylinder 10. Each plate 16 has a lead edge 18 and a tail edge 20, which are inserted into the slot 14. A notch 22 is formed in the lead edge 18 and tail edge 20 of each printing plate 16.

In a preferred embodiment, the print cylinder 10 includes two slots 14 located 180° apart around the circumference of the cylinder 10. The cylinder 10 is designed to hold eight (8) printing plates—(4) plates are wrapped 180° around one side of the cylinder 10 and the other four printing plates are wrapped 180° around the other side of the cylinder such that each of the slots 14 receives a lead edge of one plate and a tail edge of another plate. It is understood, however, that the present invention could be utilized with a different number of slots and printing plates. For example, the cylinder 10 may include only one slot 14 which receives the lead edge and tail edge of a single printing plate wrapped 360° around the circumference of the cylinder.

Figure 3:
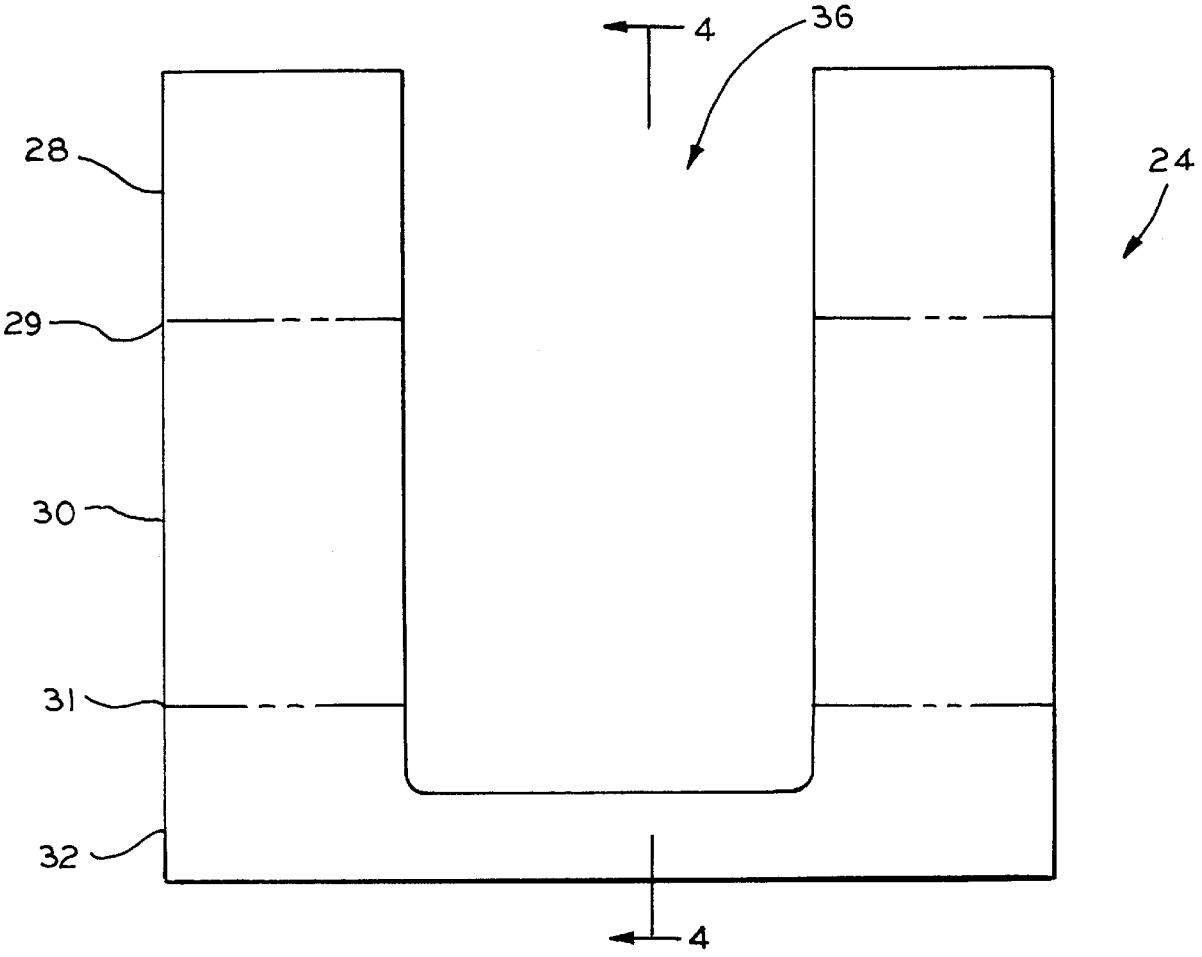
FIG. 3 is a planar view of a spring clip of the present invention used to retain the printing plates on the printing cylinder.
Figure 4:
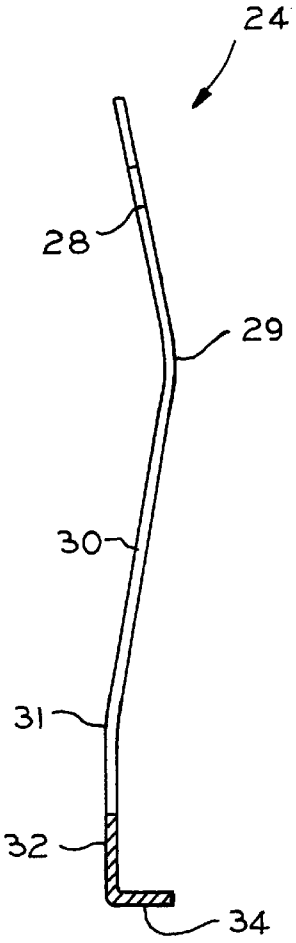
FIG. 4 is a cross-sectional view of the spring clip of the present invention taken along line 4—4 of FIG. 3.
Figure 5:
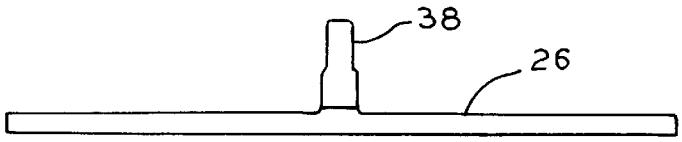
FIG. 5 is a planar view of a plate registration bracket of the present invention used to retain the printing plates on the printing cylinder.

Referring now to FIGS. 3–5, the present invention utilizes a spring clip 24 and a plate registration bracket 26 inserted into the slot 14 to retain the edges 18, 20 of the printing plate 16 in the slot 14.

FIG. 3 is a planar view of the spring clip 24 and FIG. 4 is a cross-sectional view of the spring clip 24 taken along line 4—4 of FIG. 3. The spring clip 24 includes an upper portion 28 joined to a middle portion 30 by a first elbow 29. The middle portion 30 is likewise joined to a bottom portion 32 by a second elbow 31. The first and second elbows 29, 31 form obtuse angles such that the spring clip 24 has an alinear shape, as illustrated in FIG. 4. The bottom portion 32 of the spring clip 24 includes a projection 34. Also, as seen in FIG. 3, a middle section 36 of the spring clip 24 is cut-off to form a u-shape. The spring clip 24 is preferably made from a resilient material, such as stainless steel, which allows the spring clip 24 to flex slightly upon application of a force. The spring clip 24 is designed to fit securely once it is inserted into the slot 14.

Referring to FIG. 5, the plate registration bracket 26 includes a registration pin 38 which, as explained in detail below, engages the notch 22 in the edge of the printing plate 16.

Referring to FIGS. 5–9, in accordance with the present invention, the spring clip 24 is first inserted into the slot 14 of the printing cylinder such that the projection 34 on the bottom portion 32 of the spring clip 24 engages a bottom wall 39 of the slot 14. The first elbow 29 engages a first side wall 41 of the slot 14 and the second elbow 31 of the spring clip engages a second side wall 43 of the slot 14.

Figure 7:
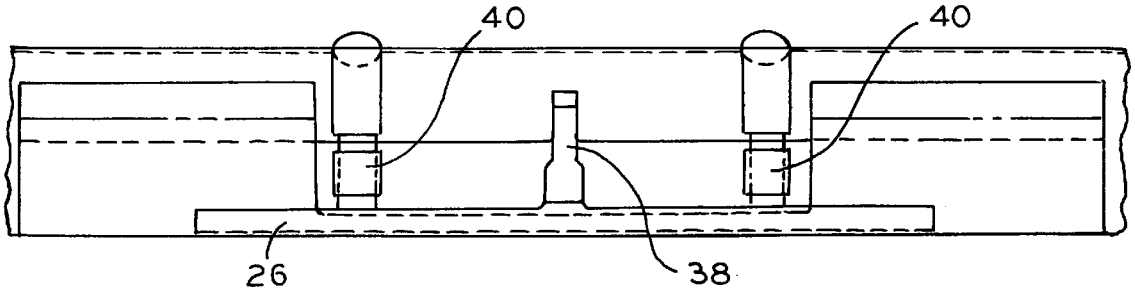
FIG. 7 is a cross-sectional view taken along line 7—7 of FIG. 6.

Next, the plate registration bracket 26 is inserted into the slot 14 atop the spring clip 24 such that the bracket 26 engages the projection 34 of the spring clip 24, holding the spring clip 24 in the slot 14. As illustrated in FIG. 7 (which is a cross-sectional view taken along line 7—7 of FIG. 6), the plate registration bracket 26 is secured in the slot by retaining screws 40, which are located on opposite sides of the registration pin 38. Since the spring clip 24 is u-shaped (FIG. 5), when the bracket 26 is inserted atop the spring clip 24, the registration pin 38 of the bracket 26 is situated in the cut-out middle section of the spring clip 24.

After the spring clip 24 and plate registration bracket 26 are secured in the slot 14, the printing plates 16 can be installed on the printing cylinder 10. Generally, one spring clip 24 and one bracket 26 are used for each printing plate. Thus, in a preferred embodiment wherein the printing cylinder 10 has two slots and eight plates are installed, eight spring clips and eight brackets are used (i.e. four in each slot).

Figure 8:
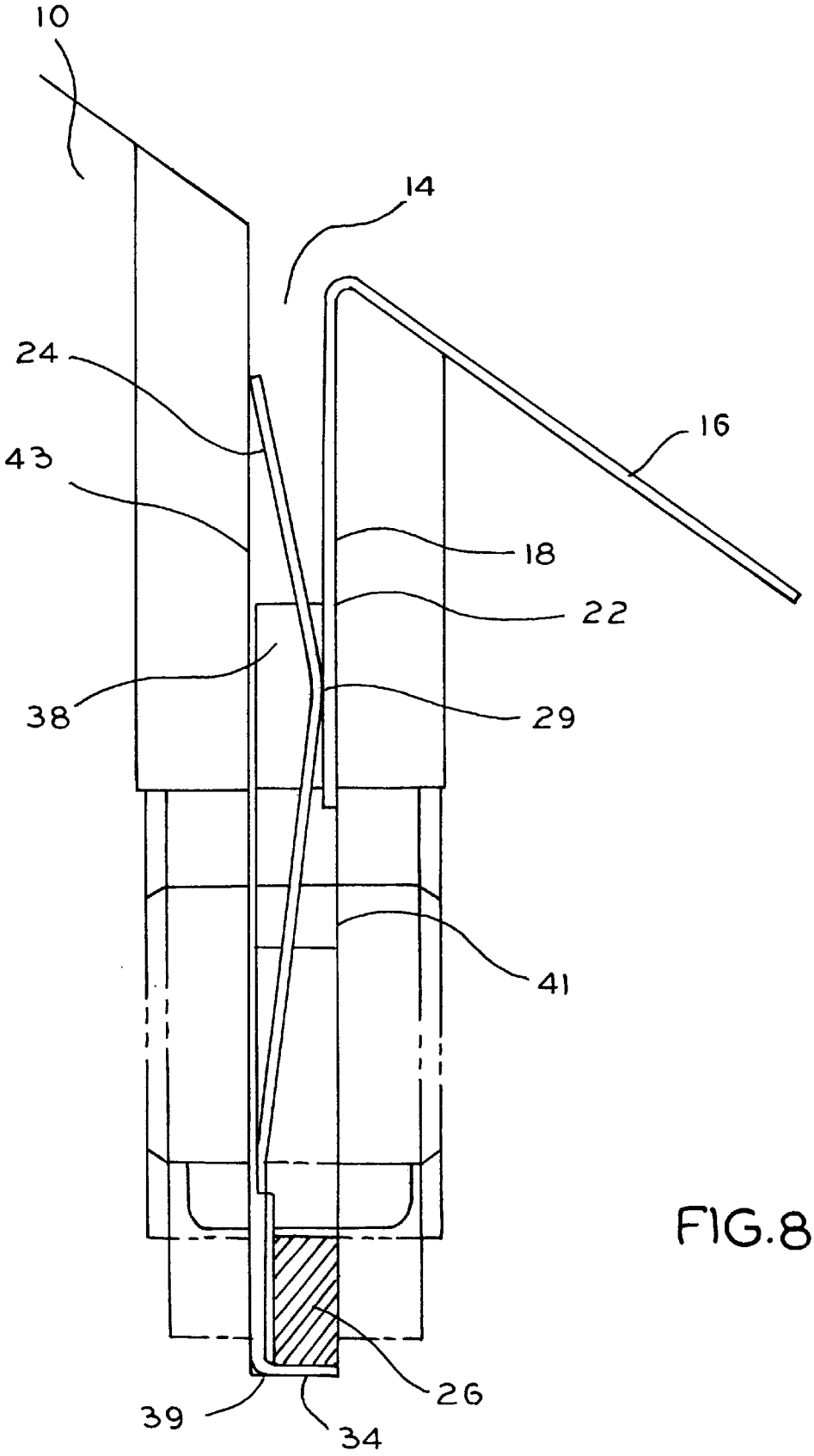
FIG. 8 is a view of one edge of a printing plate inserted into the slot and retained by the spring clip and plate registration bracket.

FIG. 8 is an enlarged view of the slot 14 in the printing cylinder 10 wherein the lead edge 18 of a printing plate 16 has been installed in the slot 14. As shown, the lead edge 18 of the printing plate 16 is inserted between the spring clip 24 and the first side wall 41 of the slot 14 and is tensioned against the side wall 41 by the first elbow 29 of the spring clip 29. The notch 22 on the printing plate 16 engages the registration pin 38 on the plate registration bracket 26 such that the plate 16 remains secure and properly aligned on the printing cylinder 10.

Figure 9:
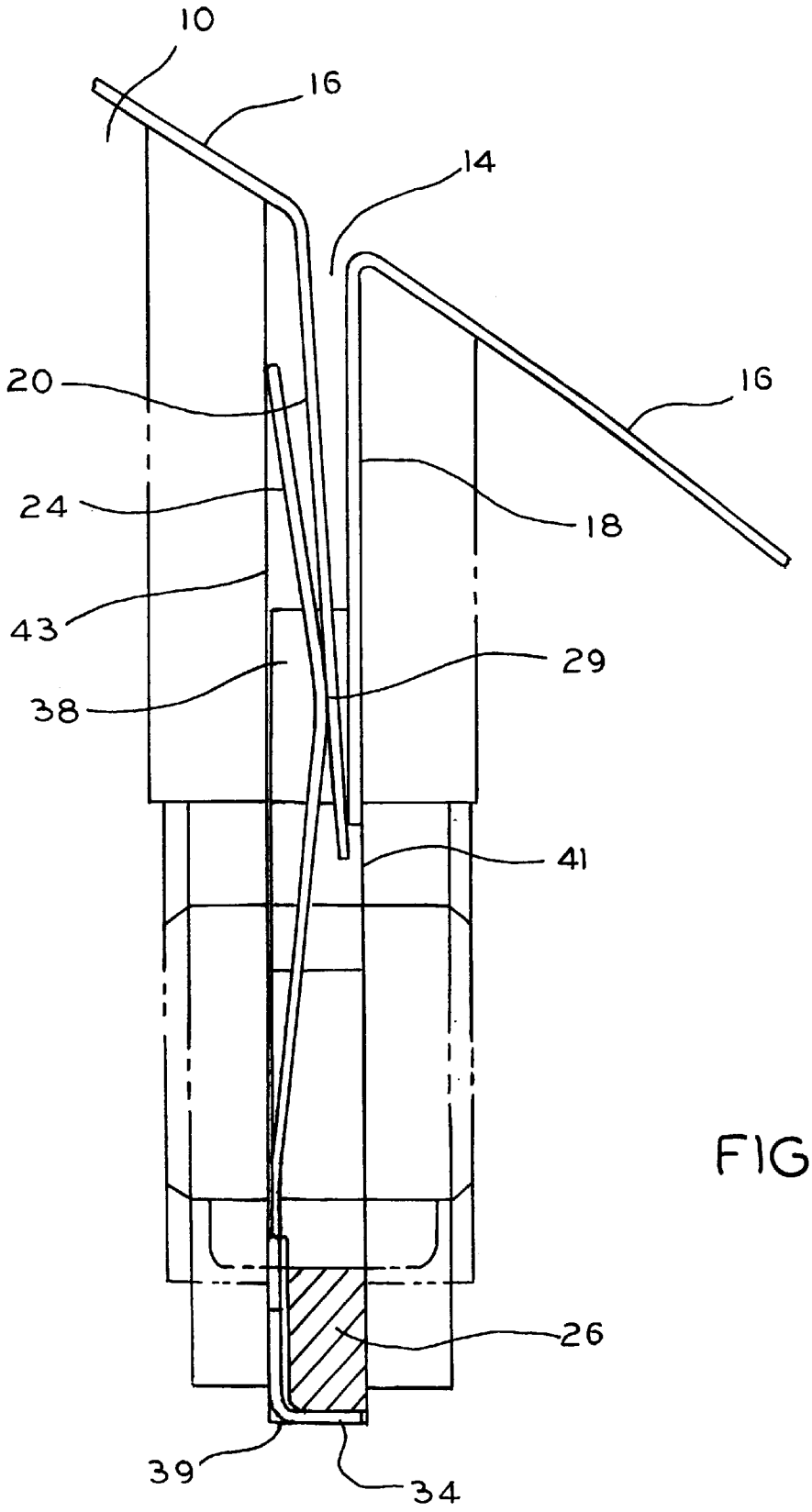
FIG. 9 is a view of two edges of a printing plate inserted into the slot and retained by the spring clip and plate registration bracket.

FIG. 9 is an enlarged view of the slot 14 in the printing cylinder 10 wherein the tail edge 20 of a printing plate 16 is also inserted into the slot 14. As shown, the tail edge 20 is inserted between the lead edge 18 and the spring clip 24. The first elbow 29 of the spring clip 24 tensions both the tail edge 20 and the lead edge 18 of the printing plate(s) 16 against the side wall 41 of the slot 14. Like the notch 22 on the lead edge 18, the notch 22 on the tail edge 20 also engages the registration pin 38 of the plate registration bracket 26 to secure and align the plate 16 on the cylinder 10.

Figure 10:
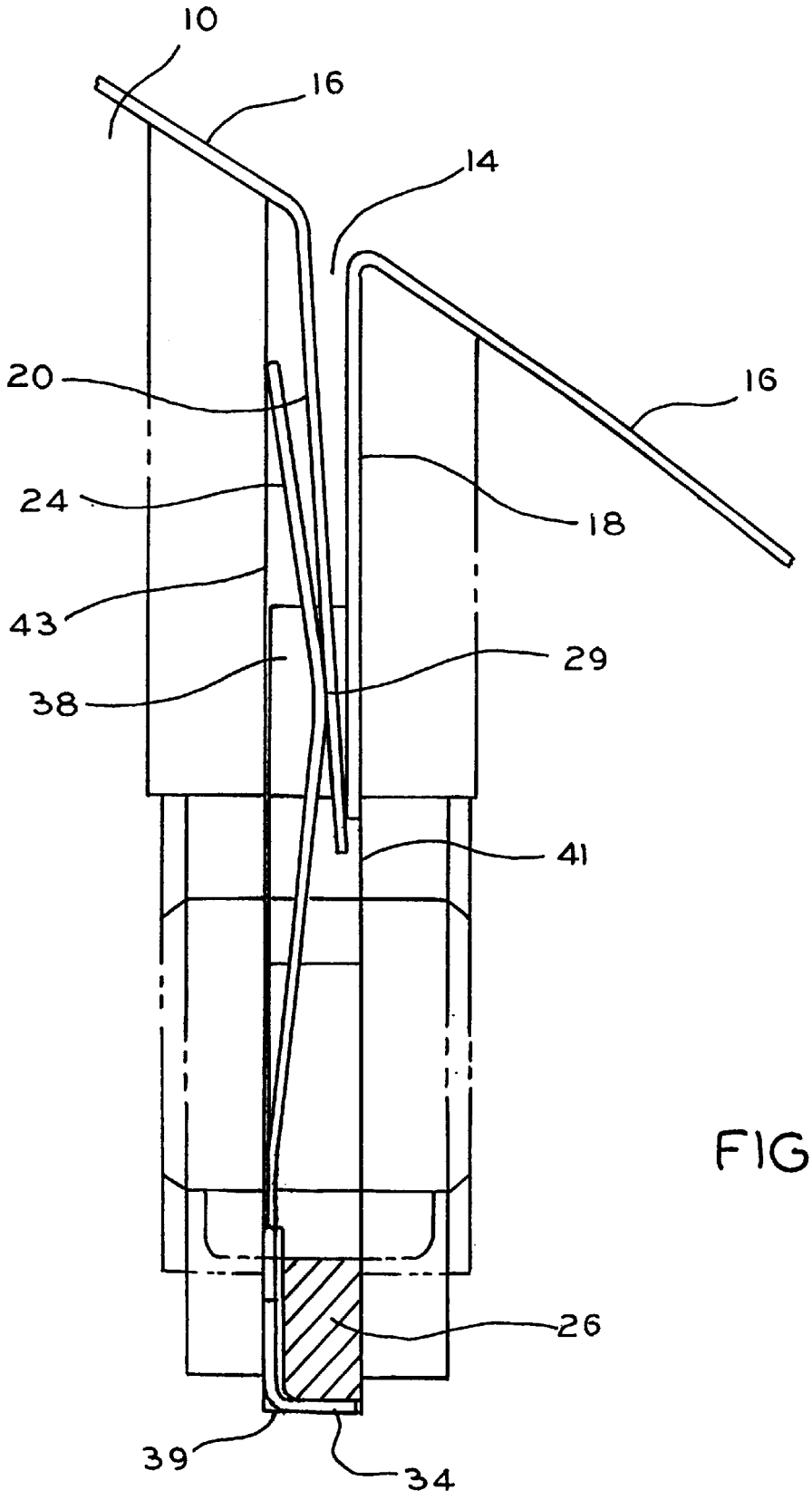
FIG. 10 is a view of two edges of a printing plate inserted into a second slot and retained by a spring clip and plate registration bracket.

In the preferred embodiment (i.e. two slots and eight printing plates), the present invention allows for the lead edge of several (e.g. four) printing plates 16 to be inserted and secured in the first slot 14 (see FIG. 9). After the lead edge of the plates 16 are secured, the print cylinder 10 is rotated 180° and the tail edge 20 of each printing plate 16 is inserted into the second slot 14 (see FIG. 10). The lead edge 18 of the remaining four plates 16 are then secured in the second slot 14. The cylinder 10 is again rotated 180° and the tail edge 20 of the remaining plates are inserted into the first slot 14. Thus, the present invention provides an advantage over prior art systems, wherein both the lead edge and the tail edge of each plate had to be secured before the next plate could be installed.

Further, the present invention provides a secure connection between the printing plates 16 and the print cylinder 10 such that the plates 16 do not become loose or disconnected when the print cylinder is rotated at high speeds (i.e. around 600 rpms).

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the system may be varied substantially without departing from the spirit of the invention, and the exclusive use of all modifications which are within the scope of the appended claims is reserved.

We claim:

1. A system for retaining one or more flexible printing plates on a print cylinder, wherein each printing plate has a first and second edge, comprising:

a slot formed axially along the cylinder, wherein the slot has first and second side walls and a bottom wall;

a spring clip including a first elbow and a projection extending from a bottom portion of the spring clip, wherein the spring clip is inserted into the slot such that the projection resides on the bottom wall of the slot;

a plate registration bracket including a registration pin, wherein the bracket is inserted into the slot atop the spring clip and engages the projection to secure the spring clip in the slot; and a notch formed on each edge of the printing plates, wherein the first edge is inserted into the slot between the spring clip and the first side wall of the slot and the second edge is inserted into the slot between the first edge and the spring clip, such that the first elbow of the spring clip tensions the edges against the first side wall of the slot and the notches engage the registration pin on the plate registration bracket.

2. The system of claim 1, further comprising a first retaining screw for securing the plate registration bracket to the slot.

3. The system of claim 2, further comprising a second retaining screw located on an opposite side of the registration pin as the first retaining screw for securing the bracket to the slot.

4. The system of claim 1, wherein the first elbow of the spring clip joins an upper portion and a middle portion of the spring clip.

5. The system of claim 4, wherein the spring clip further includes a second elbow joining the middle portion and the bottom portion and the second elbow is tensioned against the second side wall of the slot.

6. The system of claim 1, wherein the spring clip has a cut-out middle section forming a u-shape.

7. The system of claim 6, wherein the registration pin on the plate registration bracket is located in the cut-out middle section of the spring clip.

8. The system of claim 1, wherein the spring clip is manufactured from a resilient material.

9. The system of claim 1, wherein the slot is formed angularly into the cylinder.

10. The system of claim 1, wherein a second slot is formed axially along the cylinder.

11. The system of claim 10, wherein the second slot is located 180° from the first slot around the circumference of the cylinder.

12. The system of claim 11, wherein the first edge of a first printing plate is inserted into the first slot and the second edge of the first printing plate is inserted into the second slot.

13. The system of claim 12, wherein the first edge of a second printing plate is inserted into the second slot and the second edge of the second printing plate is inserted into the first slot.

14. A method for retaining one or more flexible printing plates on a print cylinder, wherein each printing plate has a first and second edge and a notch formed in each edge, comprising the steps of:

(a) inserting a spring clip including a first elbow and a projection into a slot formed axially along the cylinder, wherein the projection resides on a bottom wall of the slot;

(b) inserting a plate registration bracket including a registration pin into the slot atop the spring clip, wherein the bracket engages the projection to secure the spring clip in the slot;

(c) inserting the first edge of a printing plate into the slot between the spring clip and a side wall of the slot, wherein the first elbow of the spring clip tensions the first edge against the side wall and the notch in the first edge engages the registration pin; and (d) inserting the second edge of a printing plate into the slot between the spring clip and the first edge, wherein the first elbow of the spring clip tensions the first and second edges against the side wall and the notch in the second edge engages the registration pin.

15. The method of claim 14, further comprising the step, after step (b), of securing the plate registration bracket to the slot with a retaining screw.

16. The method of claim 14, further comprising the step, after step (b), of securing the plate registration bracket to the slot with first and second retaining screws located on opposite sides of the registration pin.

17. The method of claim 14, wherein the spring clip further comprises a second elbow that tensions against an opposite side wall of the slot when the spring clip is inserted in the slot.

18. The method of claim 14, wherein the cylinder includes a second slot located 180° from the first slot around the circumference of the cylinder.

19. The method of claim 18, wherein the first edge of a first printing plate is inserted into the first slot and the second edge of the first printing plate is inserted into the second slot.

20. The method of claim 19, wherein the first edge of a second printing plate is inserted into the second slot and the second edge of the second printing plate is inserted into the first slot.

* * * * *